US011364699B2

(12) United States Patent
Costanzo, Jr.

(10) Patent No.: US 11,364,699 B2
(45) Date of Patent: Jun. 21, 2022

(54) MANUFACTURING METHODS AND APPARATUS FOR CONTAINERS AND PACKAGING

(71) Applicant: THATBOX DESIGN, LLC, Fort Mill, SC (US)

(72) Inventor: Donn J. Costanzo, Jr., Fort Mill, SC (US)

(73) Assignee: THATBOX DESIGN, LLC, Fort Mill, SC (US)

( * ) Notice: Subject to any disclaimer, the term of this patent is extended or adjusted under 35 U.S.C. 154(b) by 287 days.

(21) Appl. No.: 16/656,542

(22) Filed: Oct. 17, 2019

(65) Prior Publication Data

US 2020/0122424 A1 Apr. 23, 2020

Related U.S. Application Data

(60) Provisional application No. 62/747,127, filed on Oct. 17, 2018.

(51) Int. Cl.
*B31B 50/26* (2017.01)

(52) U.S. Cl.
CPC ..... *B31B 50/26* (2017.08)

(58) Field of Classification Search
CPC ..... B31B 50/26; B65D 5/42; B65D 5/4266
See application file for complete search history.

(56) References Cited

U.S. PATENT DOCUMENTS 3,309,970 A * 3/1967 Pierce ..... B31B 50/00 493/311
3,552,280 A * 1/1971 Jaroch ..... B31B 50/00 493/316
3,564,980 A * 2/1971 Winters ..... B31B 50/00 493/317
4,006,670 A * 2/1977 Royal ..... B65D 5/2052 493/10
5,298,008 A * 3/1994 Decker ..... B31B 50/80 493/313
5,558,614 A * 9/1996 Anderson ..... B65B 7/20 493/312
5,624,368 A * 4/1997 Cromwell ..... B65D 5/06 493/152

(Continued)

*Primary Examiner* — Chelsea E Stinson
*Assistant Examiner* — Scott A Howell
(74) *Attorney, Agent, or Firm* — Chad D. Tillman; Tillman Wright, PLLC

(57) ABSTRACT

A machine is configured to transition a blank having a fold line extending therein directly between first and second panels thereof. The machine includes a side support configured to abut an underside of the first panel, and a vacuum gripper including a suction cup that is extendable into suctioning engagement with an underside of the second panel, and that is retractable while maintaining suctioning engagement with the underside of the second panel. The vacuum gripper is configured to pull the second panel downward by retraction of the suction cup while maintaining suctioning engagement with the underside of the second panel and while the side support abuts the first panel, whereby the first panel bends along the fold line upwardly relative to the second panel. A rod is extendable into engagement with the underside of the first panel for further bending of the first panel along the fold line.

20 Claims, 9 Drawing Sheets

(56) References Cited

U.S. PATENT DOCUMENTS

| | | | | |
|---|---|---|---|---|
| 6,474,805 | B2 * | 11/2002 | Dante | B41J 2/01 347/102 |
| 8,297,029 | B2 * | 10/2012 | Iwasa | B31B 50/00 53/377.3 |
| 8,343,024 | B1 * | 1/2013 | Costanzo, Jr. | B65D 5/241 493/128 |
| 8,562,499 | B2 * | 10/2013 | Costanzo, Jr. | B65D 5/20 493/128 |
| 9,090,038 | B1 * | 7/2015 | Bachman, Jr | B31B 50/00 |
| 9,290,281 | B2 * | 3/2016 | Iwasa | B65B 7/20 |
| 9,409,367 | B2 * | 8/2016 | Graham | B31B 50/00 |
| 9,428,293 | B2 * | 8/2016 | Yokota | B65B 5/04 |
| 9,701,089 | B1 * | 7/2017 | Costanzo, Jr. | B31B 50/26 |
| 10,472,108 | B2 * | 11/2019 | Iwasa | B31B 50/006 |
| 10,960,997 | B2 * | 3/2021 | Tatsukawa | B65B 43/10 |
| 10,981,683 | B2 * | 4/2021 | Iwasa | B65B 43/26 |
| 11,014,322 | B2 * | 5/2021 | Yokota | B31B 50/022 |
| 11,117,690 | B2 * | 9/2021 | Yokota | B65B 5/06 |
| 2012/0100976 | A1 * | 4/2012 | Graham | B31B 50/00 493/52 |
| 2012/0238423 | A1 * | 9/2012 | Costanzo, Jr. | B65D 5/4266 493/128 |
| 2021/0101354 | A1 * | 4/2021 | Iwasa | B31B 50/734 |

* cited by examiner

MANUFACTURING METHODS AND APPARATUS FOR CONTAINERS AND PACKAGING

CROSS-REFERENCE TO RELATED APPLICATION

A portion of the disclosure of the present application is explicitly set forth in the Appendix hereof, which is incorporated by reference herein, including photographs of an exemplary machine and operation thereof in accordance with one or more preferred embodiments of the invention. Additionally, the present application hereby incorporates by reference herein the disclosure of U.S. Pat. No. 8,562,499, and U.S. patent application publication 2020/0122424 ("the '424 Appl. Publication"), which represents the publication of the present application.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

COMPUTER PROGRAM LISTING

Submitted concurrently herewith via the USPTO's electronic filing system, and incorporated herein by reference, are computer program files including instructions, routines, and/or other contents of several computer programs. A table setting forth the name and size of files included in the computer program listing is included below.

| File Name | Creation Date | File Size (bytes) |
|---|---|---|
| ascify.txt | 10/08/2018 17:35 | 37473 |
| readme.txt | 10/08/2018 17:35 | 2774 |
| 201810011.txt | 10/08/2018 17:35 | 9043830 |
| 201810012.txt | 10/08/2018 17:34 | 9043692 |
| 201810013.txt | 10/08/2018 17:35 | 9043554 |
| 201810014.txt | 10/08/2018 17:35 | 9043416 |
| 201810015.txt | 10/08/2018 17:35 | 9043278 |
| 201810016.txt | 10/08/2018 17:35 | 6407647 |

One of these files, "readme.txt", contains instructions for extracting information from other of the files. These other files represent a compressed binary file that has been converted to ascii format. This file can be converted back to a compressed .zip archive utilizing an assembly conversion program source code for which is contained in "ascify.txt". The readme file includes instructions for compiling and running this conversion program, and instructions for converting the other text files to a compressed, binary file. This compressed, binary file includes two .mov videos illustrating aspects and features in accordance with one or more preferred embodiments of the invention. The disclosure of the Appendix represents screenshots from these videos.

BACKGROUND OF THE INVENTION

The invention generally pertains to improvements in manufacturing methods and apparatus for containers and packaging as disclosed, for example, in incorporated U.S.

Pat. No. 8,562,499. Aspects and feature of the invention are believed to represent one or more improvements to the apparatus and methods of the incorporated patent. Specifically, it is believed that aspects and features of the invention increase the rate of transitioning cutouts (also referred to as "blanks") by improving efficiency in the handling of the cutouts during folding.

SUMMARY OF THE INVENTION

The invention includes many aspects and features. Moreover, while many aspects and features relate to, and are described in, the context apparatus and methods relating to corrugated containers and packaging, the invention is not necessarily limited to use only in such apparatus and methods, as will become apparent from the following summaries and detailed descriptions of aspects, features, and one or more embodiments of the invention. Indeed, the invention is applicable to apparatus and methods relating to non-corrugated containers and packaging.

Accordingly, an aspect of the invention relates to a machine configured to transition a box cutout from a flat configuration to a collapsed configuration.

In another aspect of the invention, a machine configured to transition a blank having a fold line extending therein directly between first and second panels thereof comprises: a side support configured to abut an underside of the first panel; a vacuum gripper comprising a suction cup that is extendable into suctioning engagement with an underside of the second panel when the side support abuts the underside of the first panel, and that is retractable while maintaining suctioning engagement with the underside of the second panel, wherein the vacuum gripper is configured to pull the second panel downward by retraction of the suction cup while maintaining suctioning engagement with the underside of the second panel and while the side support abuts the first panel, such that the first panel bends along the fold line upwardly relative to the second panel; and a rod that is extendable into engagement with the underside of the first panel while the side support abuts the underside of the first panel following said retraction of the suction cup and bending of the first panel upwardly relative to the second panel and that is further extendable for further bending of the first panel along the fold line.

In a feature of this aspect, the rod is further extendable for further bending along the fold line of the first panel at least partially over a top side of the second panel.

In another feature, an opening extends through the side support and the rod extends through the opening between opposite sides of the side support when the rod is extended into engagement with the underside of the first panel.

In a feature, the rod is configured to engage the underside of the first panel between the abutment of the side support with the underside of the first panel and the fold line in the blank extending directly between the first and second panels. Furthermore, an opening preferably extends through the side support and the rod preferably extends through the opening between opposite sides of the side support when the rod is extended into engagement with the underside of the first panel.

In a feature, the side support comprises a plate having a top edge on which the blank slides and is supported.

In a feature, the vacuum gripper further comprises a piston having a distal end; a connector attached to the distal end; and a suction line attached to the connector; wherein the suction cup is attached to the connector and wherein the connector connects the suction line to the suction cup for the application of suction at the suction cup.

In a feature, the vacuum gripper ceases the suctioning engagement with the underside of the second panel after the further bending of the first panel by the further extension of the rod while in the engagement with the underside of the first panel.

In a feature, the machine further comprises a plunger in a plunging area of the machine, wherein the side support, vacuum gripper, and rod are located within the plunging area such that the plunger is configured to lower and engage the blank after the engagement of the rod with the first panel. Furthermore, the vacuum gripper preferably ceases the suctioning engagement with the underside of the second panel during the lowering of the plunger.

In a feature, the machine further comprises three additional side supports, vacuum grippers, and rods for transitioning of the blank.

In a feature, the first panel defines a corner of the blank prior to transitioning thereof by the machine.

In another aspect, a machine configured to transition a blank having a fold line extending therein directly between first and second panels thereof comprises first means for bending the first panel upwardly relative to the second panel, and second means for further bending the first panel at least partially over a top side of the second panel.

In another aspect a method of transitioning a blank having a fold line extending therein directly between first and second panels thereof comprises the steps of: positioning the blank such that an underside of the first panel is supported by a side support; and, while the underside of the first panel is supported by the side support, (i) extending into suctioning engagement with an underside of the second panel a suction cup of a vacuum gripper, (ii) retracting the suction cup while maintaining suctioning engagement thereof with the underside of the second panel such that the vacuum gripper pulls the second panel downward and the first panel bends along the fold line upwardly relative to the second panel, and (iii) extending a rod into engagement with the underside of the first panel to effect further bending of the first panel along the fold line.

In a feature, the rod is extended such that the first panel is at least partially bent along the fold line over a top side of the second panel.

In a feature, the rod extends through an opening in the side support between opposite sides of the side support when the rod is extended into engagement with the underside of the first panel.

In a feature, the rod is extended to engage the underside of the first panel between (i) the area of support by the side support of the underside of the first panel and (ii) the fold line in the blank extending directly between the first and second panels. Furthermore, the rod preferably extends through an opening in the side support between opposite sides of the side support when the rod is extended into engagement with the underside of the first panel.

In a feature, the side support comprises a plate having a top edge on which the blank slides and is supported when the blank is positioned.

In a feature, the method further comprises the step of ceasing the suctioning engagement of the suction cup with the underside of the second panel after effecting the bending of the first panel by the extension of the rod.

In a feature, the method further comprises the step of plunging of the blank with a plunger after or while ceasing the suctioning engagement of the suction cup with the underside of the second panel.

In a feature, the first panel defines a corner of the blank.

In a feature, the method further comprises additional steps of bending the blank such that the blank forms a box or cooler in a collapsed configuration.

In a feature, the method further comprises gluing the blank during the transitioning.

In another aspect, a method for transitioning a blank having a fold line extending therein directly between first and second panels thereof comprises: a first step for bending along the fold line the first panel upwardly relative to the second panel; and, a second step for further bending along the fold line the first panel at least partially over a top side of the second panel.

In a feature, the method further comprises steps of bending the blank such that the blank forms a box or cooler in a collapsed configuration.

In a feature, the method further comprises a step of gluing the blank during the transitioning.

Another aspect comprises an apparatus as disclosed herein.

Another aspect comprises a method as disclosed herein.

Another aspect comprises a method of transitioning a box cutout from a flat configuration to a collapsed configuration as disclosed herein.

Another aspect comprises a machine for transitioning a box cutout from a flat configuration to a collapsed configuration as disclosed herein.

Another aspect comprises a box manufactured utilizing a machine for transitioning a box cutout from a flat configuration to a collapsed configuration as disclosed herein.

Another aspect comprises a method of transitioning a blank as disclosed herein.

Another aspect of the invention relates to an apparatus.

Another aspect of the invention relates to a method.

Another aspect of the invention relates to a box cutout.

Another aspect of the invention relates to a method of transitioning a box cutout from a flat configuration to a collapsed configuration.

Another aspect of the invention relates to a machine for transitioning a box cutout from a flat configuration to a collapsed configuration.

Another aspect of the invention relates to a box manufactured utilizing a machine for transitioning a box cutout from a flat configuration to a collapsed configuration.

Another aspect of the invention relates to a system comprising any of the foregoing aspects.

Still further aspects and features of the invention are disclosed in the Appendix attached hereto and incorporated herein by reference; and in the videos of the computer program listing incorporated herein by reference.

In addition to the aforementioned aspects and features of the invention, it should be noted that the invention further encompasses the various possible combinations and subcombinations of such aspects and features. Thus, for example, any aspect may be combined with an aforementioned feature in accordance with the invention without requiring any other aspect or feature.

BRIEF DESCRIPTION OF THE DRAWINGS

One or more preferred embodiments of the invention now will be described in detail with reference to the accompanying drawings.

DETAILED DESCRIPTION

Figure 1:
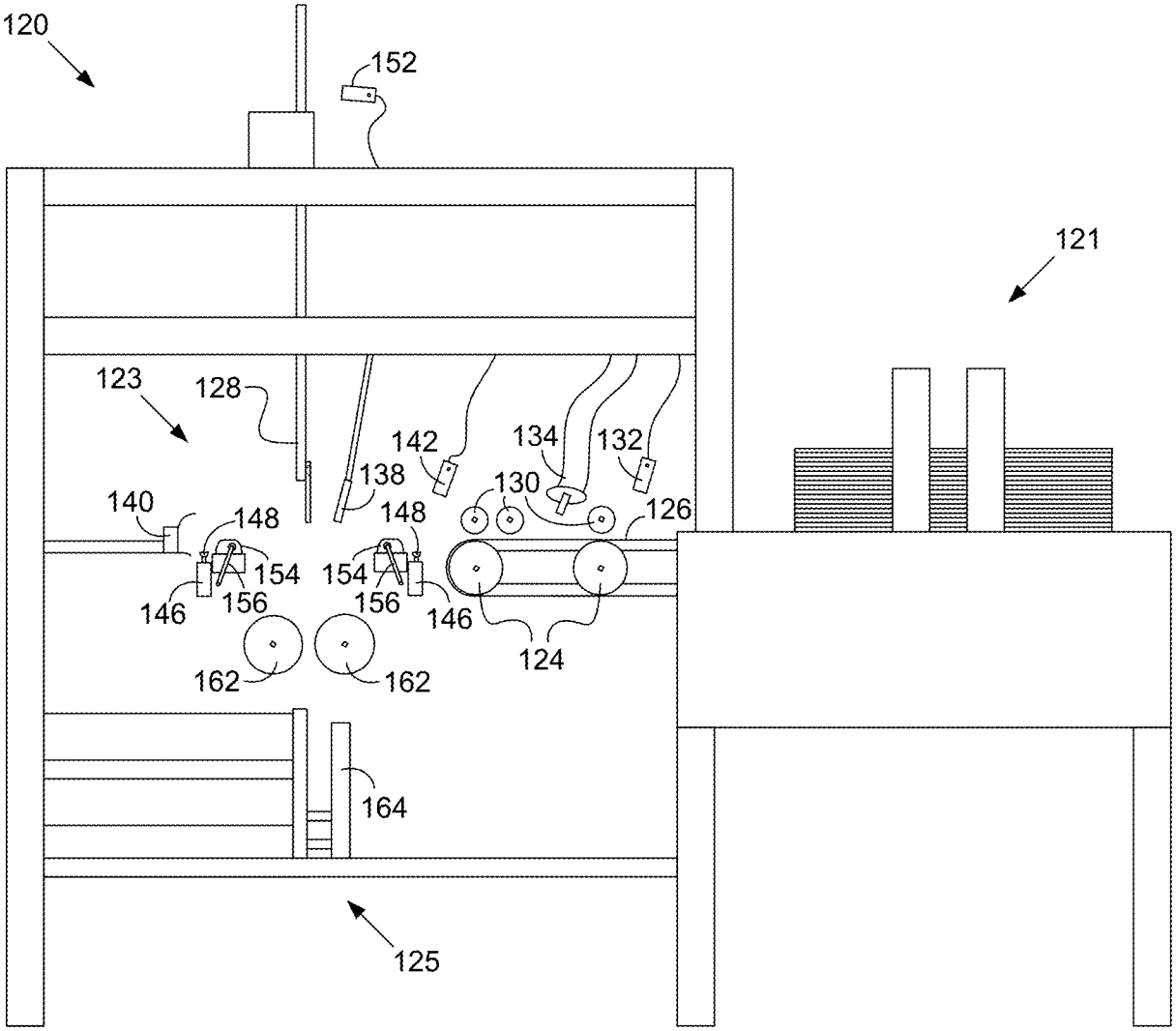
FIGS. 1-9 each is a schematic illustration of an exemplary machine 120 and, specifically, components thereof, which machine 120 is representative of a preferred embodiment in accordance with one or more aspects and features of the invention.

As a preliminary matter, it will readily be understood by one having ordinary skill in the relevant art ("Ordinary Artisan") that the invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the invention. Other embodiments also may be discussed for additional illustrative purposes in providing a full and enabling disclosure of the invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the invention.

Accordingly, while the invention is described herein in detail in relation to one or more embodiments, it is to be understood that this disclosure is illustrative and exemplary of the invention, and is made merely for the purposes of providing a full and enabling disclosure of the invention. The detailed disclosure herein of one or more embodiments is not intended, nor is to be construed, to limit the scope of patent protection afforded the invention, which scope is to be defined by the claims and the equivalents thereof. It is not intended that the scope of patent protection afforded the invention be defined by reading into any claim a limitation found herein that does not explicitly appear in the claim itself Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the invention. Accordingly, it is intended that the scope of patent protection afforded the invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. § 112(f), no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers."

When used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

The phrase "at least one" followed by a list of items joined by "and" denotes an item of the list but does not require every item of the list. Thus, "at least one of an apple and an orange" encompasses the following mutually exclusive scenarios: there is an apple but no orange; there is an orange but no apple; and there is both an apple and an orange. In these scenarios if there is an apple, there may be more than one apple, and if there is an orange, there may be more than one orange. Moreover, the phrase "one or more" followed by a list of items joined by "and" is the equivalent of "at least one" followed by the list of items joined by "and".

Additionally, as used herein, a "fold line" is intended to mean that along which something is folded and may comprise a "score line". A "score line" is intended to mean an elongated area along which a fold is predisposed to form upon application of force. Within this broader context, a score line may be a generally linear area of weakness formed in a corrugated or non-corrugated panel along which the panel is predisposed to fold upon application of a force on the panel. A score line may be formed by way of example, and not limitation, by notching, scratching, incision, compression, perforation, physical deformation, or otherwise.

Referring now to the drawings, one or more preferred embodiments of the invention are next described. The following description of one or more preferred embodiments is merely exemplary in nature and is in no way intended to limit the invention, its implementations, or uses.

Schematic illustrations of an exemplary machine 120 representative of a preferred embodiment in accordance with one or more aspects and features of the invention are seen in FIGS. 1-9. The machine 120 of FIGS. 1-9 is configured to fold box cutouts (also referred to as "blanks") into assembled and collapsed boxes. The blanks may include a waterproof or water-resistant coating for use of the boxes formed thereby as coolers. Specifically, each blank is automatically transitioned by the machine 120 from an initial, flat and unfolded configuration of the blank to a fully formed but folded and collapsed configuration of the blank, which may comprise a collapsed box or cooler. In the collapsed configuration, the box or cooler that is formed is in an ideal state for storage or transport and can be readied for use by simply expanding the box or cooler from the collapsed configuration to an expanded, use configuration.

With regard to the exemplary machine 120, FIG. 1 is a schematic side view of certain components thereof. As illustrated, the machine 120 includes a blank-input area 121 that is configured to receive a vertical stack of blanks each in a flat, unfolded configuration as input feed to the machine 120. The machine further includes a plunging area 123 where transitioning of the blank occurs, and a collection area 125 or "pen" where collection of the transitioned blanks occurs.

The Blank-Input Area

Figure 2:
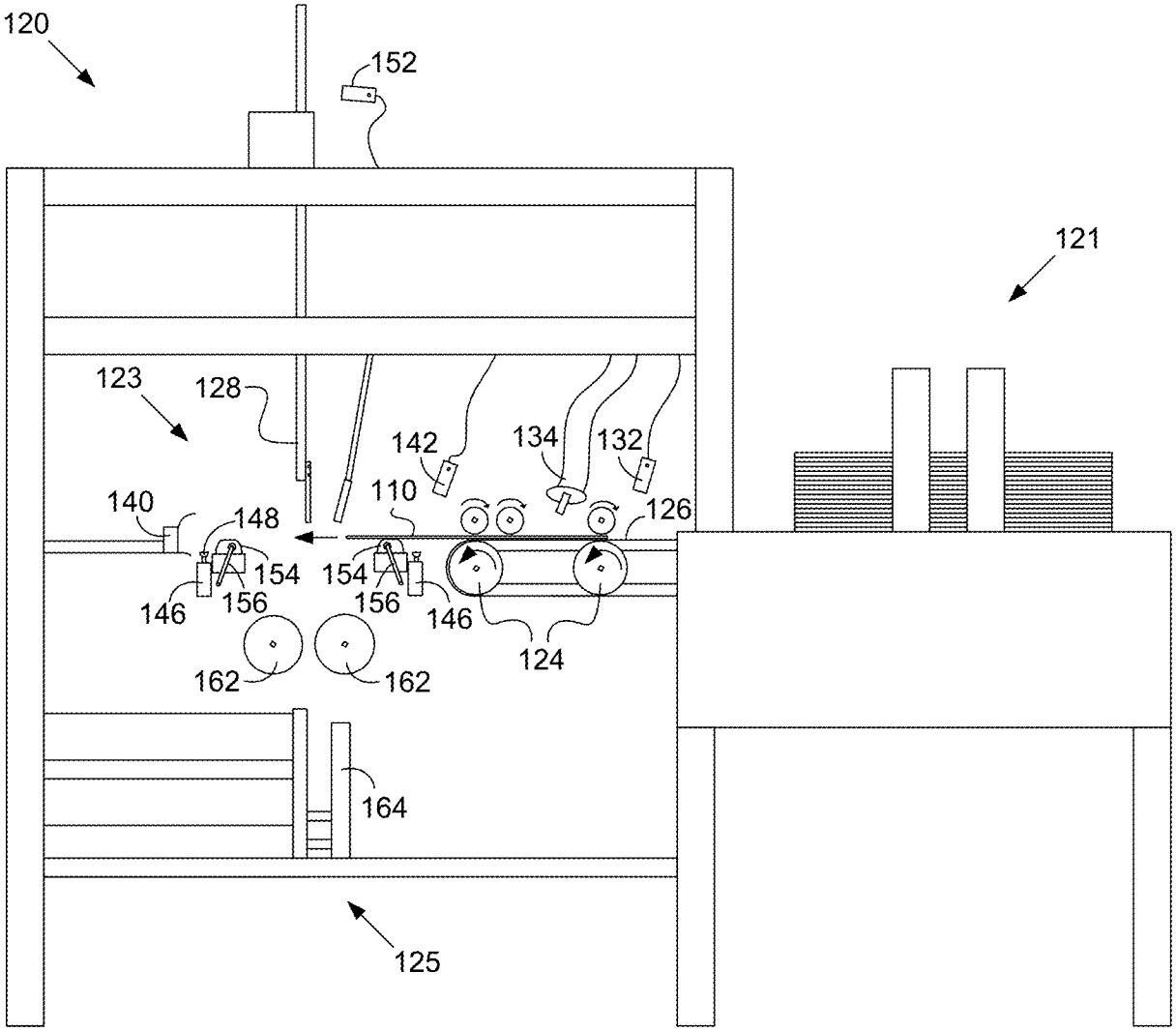

In the blank-input area 121, the machine 120 is configured receive a stack of blanks. The bottom-most blank then is taken from the stack and propelled forward by, inter alia, a drive belt 126 that is driven by one or more drive wheels 124. The drive belt 126 propels each blank toward the plunging area 123. As seen in FIG. 2, a particular blank 110 is being propelled by the drive belt 126 toward the plunging area. The machine 120 includes one or more free wheels 130 which serve to, inter alia, minimize or inhibit lifting of the blank 110 as it is propelled by the drive belt 126. The machine 120 also comprises a first sensor or detector 132, preferably in the form of a laser detector, and one or more glue applicators 134. In operation, the first detector 132 detects the passing of the blank 110 and triggers application of glue to the passing blank 110 via the one or more glue applicators 134. The one or more glue applicators 134 may be configured to apply glue to a bottom of the blank 110, to a top of the blank 110, or to both a bottom and a top of the blank 110. The glue is preferably fast drying glue; however, it will be appreciated that the process need not pause in order for the glue to set, as the portions of the blank 110 to which glue is applied are maintained in proper position in the fully formed but folded and collapsed configuration of the blank during collection in the collection area 125, thereby enabling the glue to set in the collection area 125 of the machine 120. In accordance with one or more preferred implementations, glue is sprayed onto the blank 110 as it is whisked by at a high speed without stopping.

The Plunging Area

Figure 3:
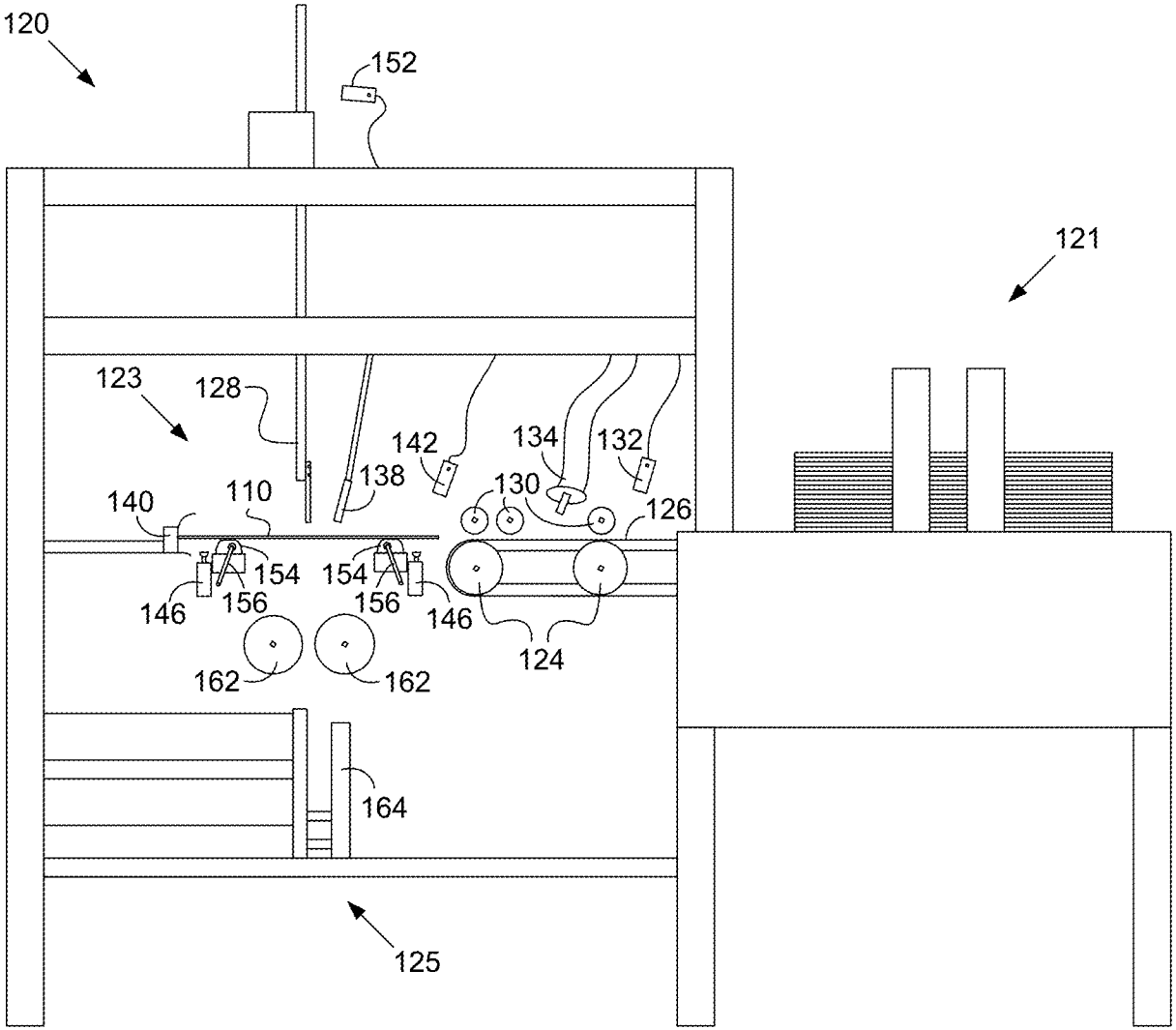

Propelled by the drive belt 126, the blank 110 moves into the plunging area 123 under a plunger 128, as seen in FIG. 3. A deflector 138 is utilized immediately upstream of the plunger 128, which serves to deflect the blank 110 downward so that the leading edge of the blank 110 passes under a head of the plunger 128 in the event that the blank 110 begins to lift up as it is propelled at a high speed toward into the plunging area 123. The deflector preferably is comprised of a pliable material such as, for example, a silicon plastic or other plastic material. The machine 120 includes in the plunging area 123 a backstop 140 that is positioned relative to the plunger 128 based on the dimensions of the blanks such that, when an end of the blank 110 hits the backstop 140, a central portion of the blank 110 stops directly below the head of the plunger 128, as seen in FIG. 3. The machine 120 also comprises side supports in the form of four side support plates 154 located in the plunging area 123 proximate the ends and on opposite lateral sides of the blank 110, which blank 110 when received in the plunging area 123 rests on top of these side support plates 154. The machine 120 preferably includes a second laser detector 142 that is utilized to trigger the beginning of a plunging routine upon the detection of the passing of the blank 110 into the plunging area 123.

Vacuum Grippers in the Plunging Area

Figure 4:
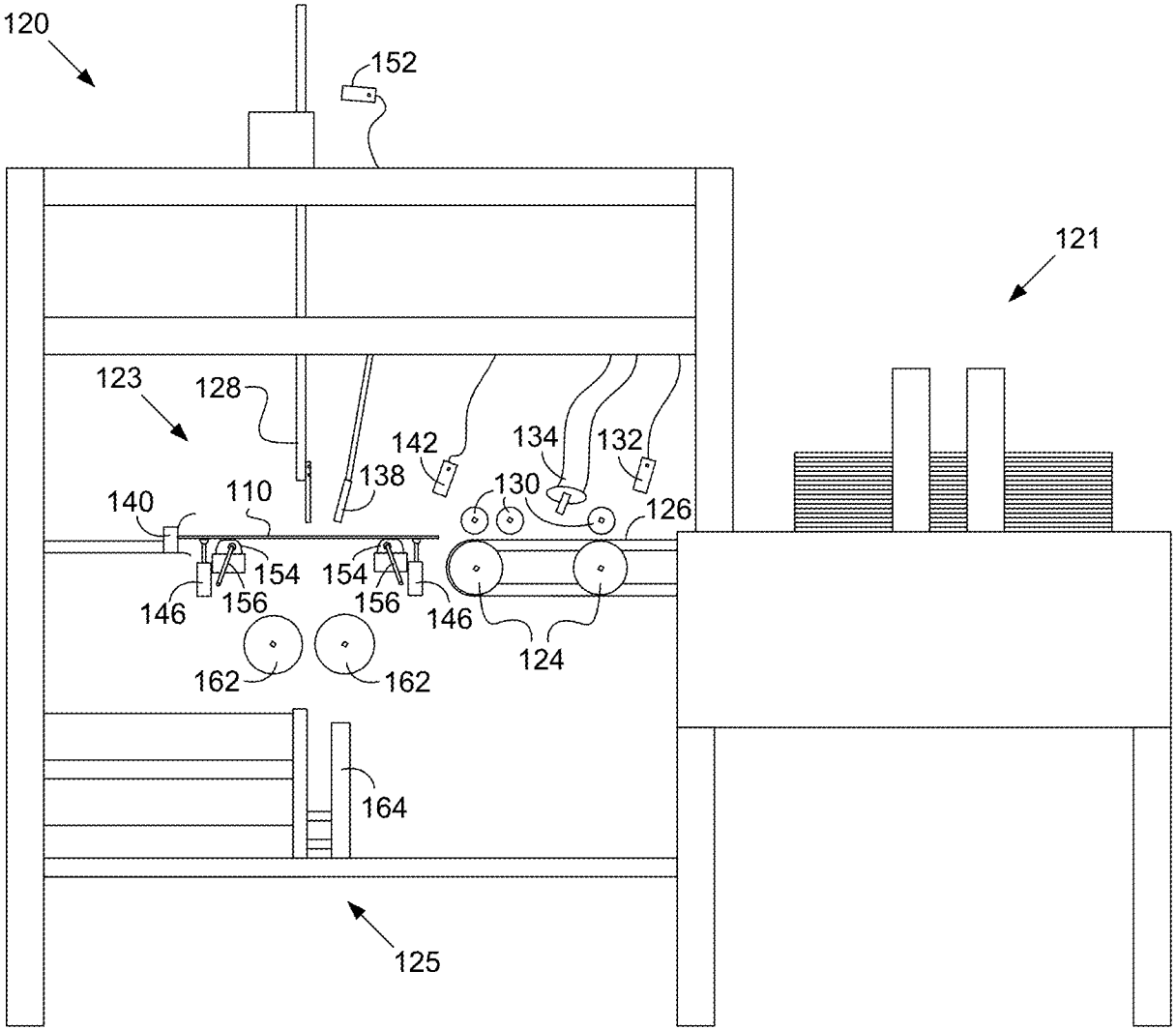
Figure 5:
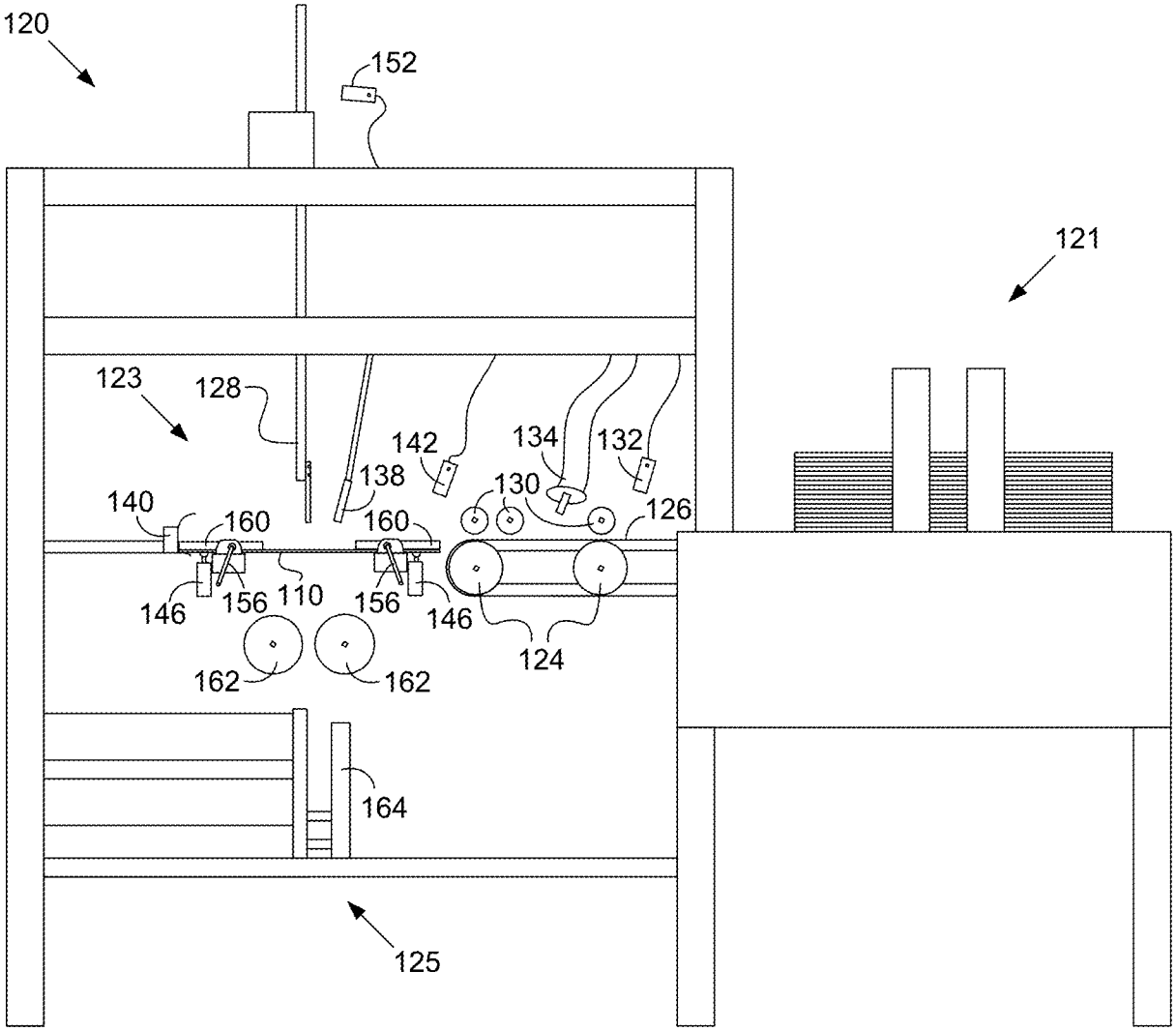
Figure 6:
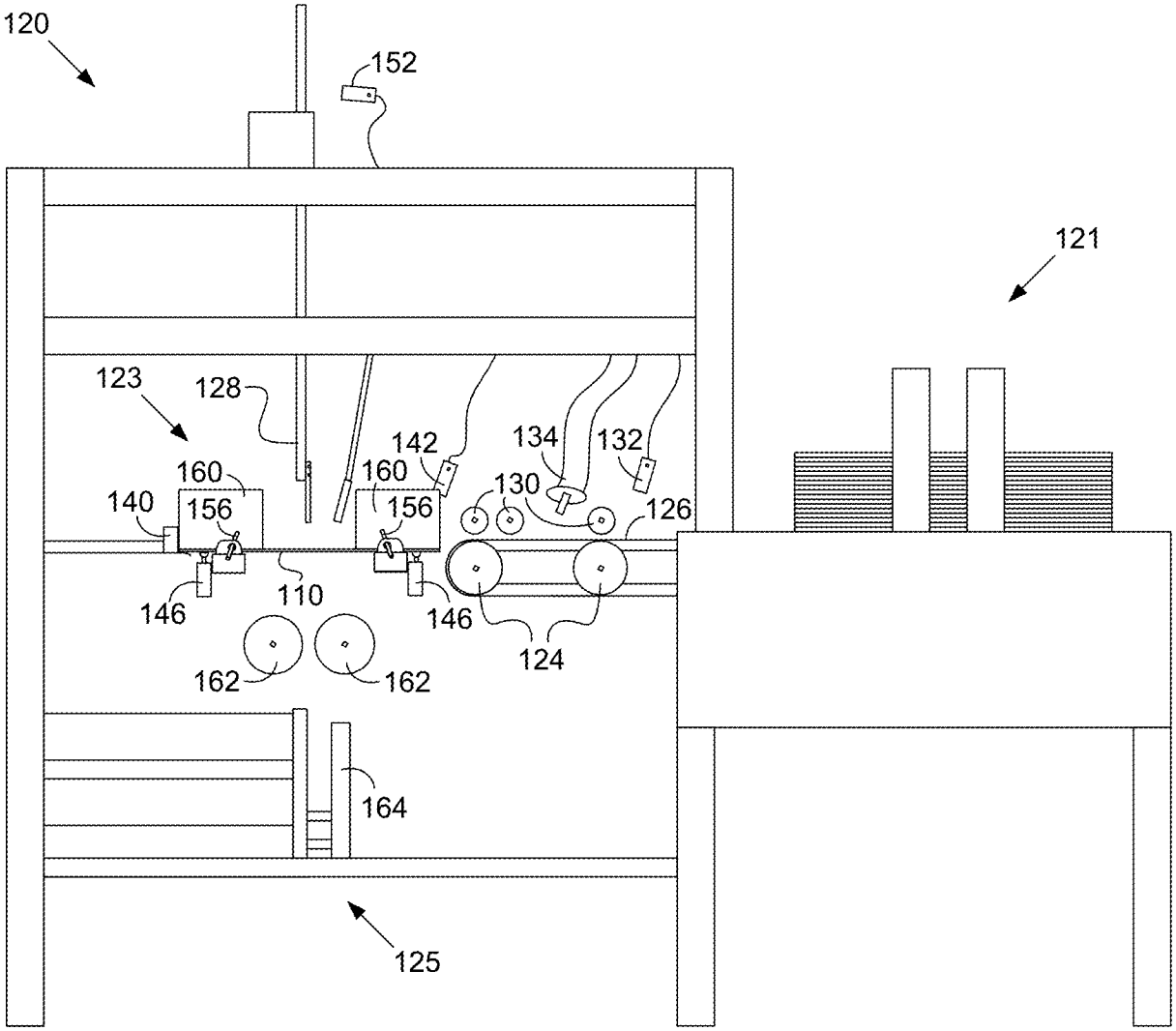
Figure 7:
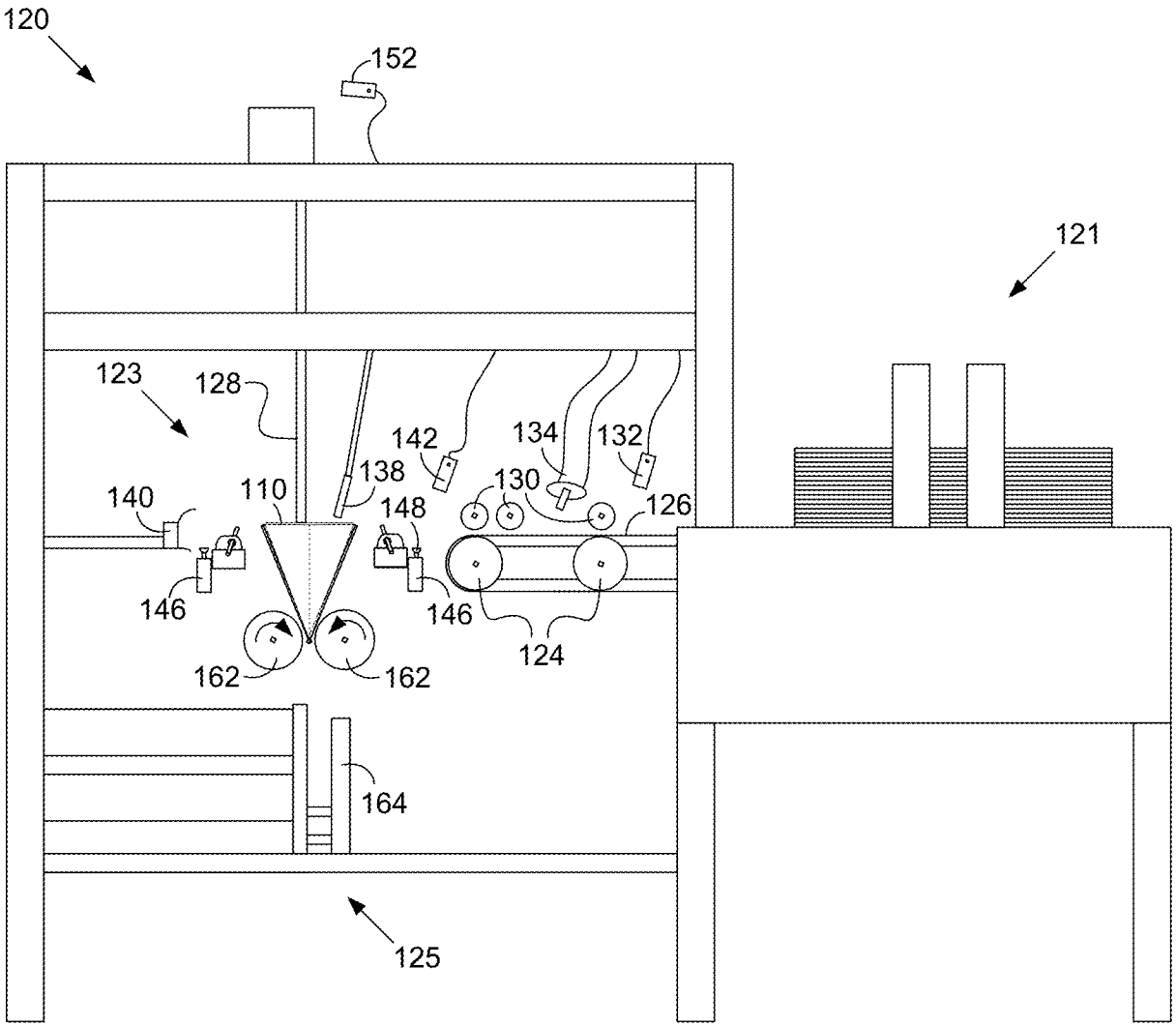

The machine 120 includes one or more vacuum grippers 146 configured to engage and manipulate the blank 110 when received within the plunging area 123. Specifically, once the blank 110 is received within the plunging area 123 in position below the head of the plunger 128, the plunging routine begins with suction cups 148 of the vacuum grippers 146—each comprising a suction cup—being extended upward into engagement with the blank 110, as seen in FIG. 4. Each suction cup 148 engages and attaches via suction to a surface of a panel of the blank 110, to which panel a pair of adjacent panels 160 is attached each on an opposite sides thereof with a fold line extending therebetween. It is these adjacent panels 160 that rest upon the side support plates 154. The suction cups 148 then are retracted, pulling downward the panels of the blank 110 to which the suction cups are attached 148, as seen in FIG. 5. This results in the adjacent panels 160 being bent upwardly about the fold lines relative to the panels of the blank 110 that have been pulled downwardly, as further seen in FIG. 5. Next, rods 156 are extended through openings in the side support plates 154 for abutment with and further bending of the adjacent panels that have already been bent upwardly upon the retraction of the suction cups 148. These rods 156 further bend upwardly and inwardly the adjacent panels, as seen in FIG. 6.

Following such folding by the rods 156, suction that is applied via the vacuum grippers 146 is discontinued such that the panels of the blank 110 previously engaged by the suction cups 148 are released, and the plunger 128 is utilized to effect collapsing of the blank 110 by thrusting a middle portion of the blank 110 downward along another fold line that bisects the blank 110. The plunging mechanism may comprise, for example, an elongate rod or bar that is mechanically, electrically, and/or pneumatically driven. The head of the plunger 128 is preferably sized and dimensioned based on the blank to which it is to apply pressure during a particular run of the machine 120. During such plunging, the adjacent panels 160 of the blank 110 are brought into abutment with other panels and glue applied via the one or more glue applicators 134 secures such panels together.

As the blank 110 descends, it comes into contact with drive wheels 162 that are configured to "grab" the blank 110, pull the blank 110 from the plunger 128 and further propel the blank 110 downward toward the collection area 125. Accordingly, the drive wheels 162 can be characterized as grab wheels 162. The drive wheels 162 further press the blank 110 together as it passes between the drive wheels 162. Two sets of opposed drive wheels are illustrated; however, additional drive wheel sets may be utilized, with the drive wheel arrangement including opposed drive wheels generally stacked in a converging "v" formation. In addition, or as an alternative thereto, a drive belt may be utilized as seen, for example, in connection with the apparatus 220 of FIGS. 10-33 of the '424 Appl. Publication.

The Collection Area

Figure 8:
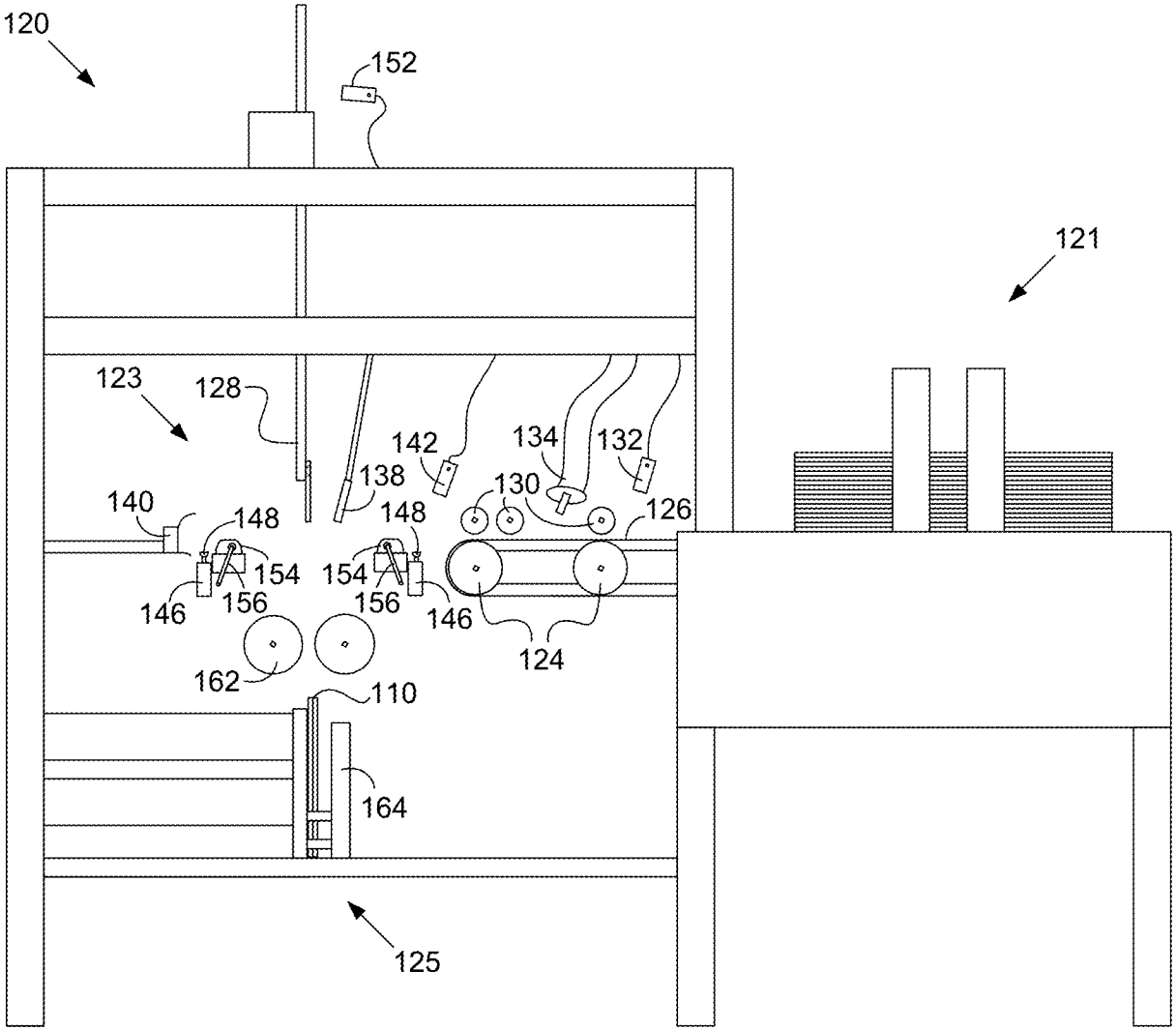
Figure 9:
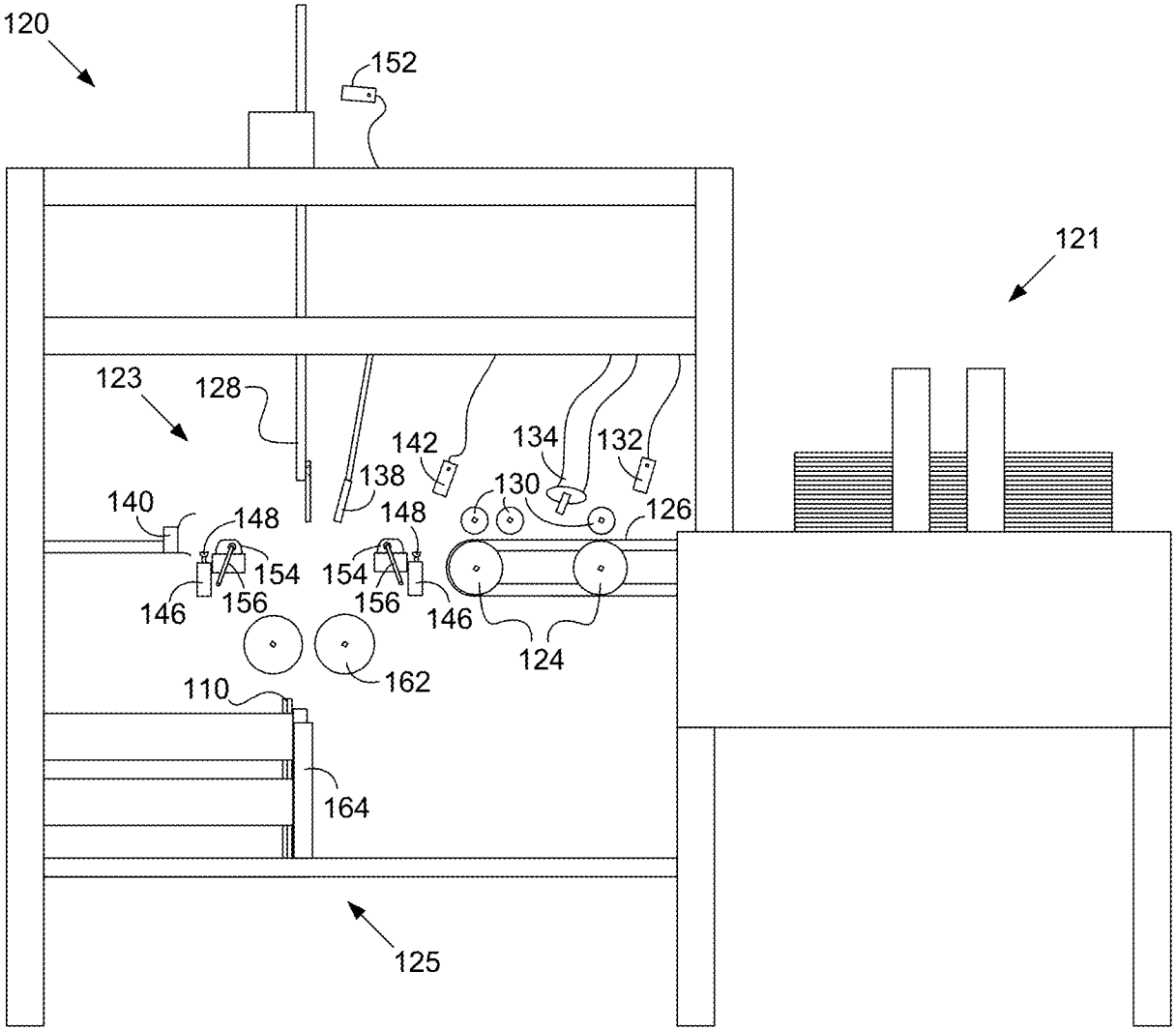

Thereafter, the formed and collapsed blank 110 is deposited into the collection area 125. The collection area 125 includes a stall 127 in which a horizontal stack of blanks that are fully formed but folded and collapsed are collected. In particular, the blank 110 is received at an initial opening of the stall 127, as seen in FIG. 8, and then pushed into the stall 127 by sliding end wall 164, as seen in FIG. 9. This insertion into the stall 127 is triggered by laser detector 152, which detects that return of the plunger to its original position, thereby indicating the plunging of a blank into the collection area 125.

As blanks are processed by the machine 120, they are collected in the collection area 125; it will be appreciated that blank 110 is the first blank to be received within the stall 127 in the illustrated example. Because the stack of blanks in the blank-input area 121 are processed one at a time in series, it is important that the time needed to transition each blank is as short as possible, whereby a greater number of formed, collapsed blanks may be made in a given period of time. To this end, it has been found that use of the vacuum grippers 146 for engaging and folding of each blank in the plunging area 123 shortens the time needed for processing the blank, thereby improving efficiencies over the conventional apparatus and methods as disclosed in incorporated U.S. Pat. No. 8,562,499. It therefore is believed that such use of the vacuum grippers represents an innovative improvement over such conventional apparatus and methods.

Exemplary Prototype Machine

An exemplary machine 120 configured to process blanks has been described herein with reference to the schematic illustrations of FIGS. 1-9. Photographs of a prototype machine representative of another embodiment 220 in accordance with one or more aspects and features of the invention is illustrated in FIGS. 10-33 of the '424 Appl. Publication. While not identical, such embodiment 220 is similar in structure and operation to that of embodiment 120 described above with reference to FIGS. 1-9, as will be appreciated by the Ordinary Artisan.

Accordingly, a top perspective view of a plunging area of the machine 220 is seen in FIGS. 10-20 of the '424 Appl. Publication, and a bottom perspective view of the plunging area of the machine 220 is seen in FIGS. 21-31 of the '424 Appl. Publication. A closeup perspective view of a vacuum gripper including suction cup thereof is seen in FIG. 32 of the '424 Appl. Publication; and a general perspective view of the plunging area of the machine 220 together with part of the blank-input area of the machine 220 is seen in FIG. 33 of the '424 Appl. Publication.

A blank 210 is propelled into the plunging area by a drive belt, as seen in the sequence of FIGS. 10-13 and 22-23 of the '424 Appl. Publication.

In the transition from FIG. 11 to FIG. 12 of the '424 Appl. Publication, a "bump" is seen as the blank 210 rides up onto the first set of guiding plates 254 while traveling toward the plunging area.

In FIG. 13 and FIGS. 24-25 of the '424 Appl. Publication, suction cups of the vacuum grippers are extended into contact with the underside of panels 211,213 of the blank 210.

In FIGS. 14-15 and FIGS. 26-28 of the '424 Appl. Publication, the suction cups of the vacuum grippers are retracted, with the panels 211,213 being pulled downward and with the adjacent panels 260 being folded upwardly due to their engagement with the tops of the side support plates 254.

In FIGS. 16-18 and FIGS. 29-30 of the '424 Appl. Publication, the rods 256 are extended for further folding of the adjacent panels 260.

In FIGS. 19-21 and FIG. 31 of the '424 Appl. Publication, the plunger engages and pushes the blank 210 into engagement with converging drive belts 271,273 that propel the blank 210 away from the plunging area downward toward a collection area.

A closeup perspective view of a vacuum gripper 246 including suction cup 248 thereof is seen in FIG. 32 of the '424 Appl. Publication. The vacuum gripper 246 comprises a piston 269 having a distal end; a connector 289 attached to the distal end; and a suction line 283 attached to the connector 289. The vacuum gripper 246 further includes a housing 287 from which the piston 269 extends and within which the piston 269 retracts. Movement of the piston 269 is effected via pneumatic or hydraulic control line 285. The suction cup 248 is attached to the connector 289 which connects the suction line 283 to the suction cup 248 for the application of suction. The suction cup 248 includes a lip 249 for sealing engagement with a surface of a blank when suction is applied. A guide support plate 254 is also partially seen in FIG. 32 of the '424 Appl. Publication.

The Appendices

Appendix #1 to the present application, which is incorporated herein by reference, includes a sequence of photographs in greater detail demonstrating the operation of the prototype machine 220 from a perspective showing a topside of a blank as it is folded. Appendix #2 to the invention, which also is incorporated herein by reference, includes another sequence of photographs demonstrating in greater detail the same operation from a different perspective showing the underside of the blank as it is folded.

Closing

Although description herein largely focuses on blanks and boxes made from corrugated material, systems, methods, and apparatus described herein could equally be utilized in other contexts and with other materials, including other packaging contexts. For example, innovations described herein could equally be utilized in the context of containers having non-corrugated walls, such as cartons for example.

Based on the foregoing description, it will be readily understood by those persons skilled in the art that the invention is susceptible of broad utility and application. Many embodiments and adaptations of the invention other than those specifically described herein, as well as many variations, modifications, and equivalent arrangements, will be apparent from or reasonably suggested by the invention and the foregoing descriptions thereof, without departing from the substance or scope of the invention. Accordingly, while the invention has been described herein in detail in relation to one or more preferred embodiments, it is to be understood that this disclosure is only illustrative and exemplary of the invention and is made merely for the purpose of providing a full and enabling disclosure of the invention. The foregoing disclosure is not intended to be construed to limit the invention or otherwise exclude any such other embodiments, adaptations, variations, modifications or equivalent arrangements, the invention being limited only by the claims appended hereto and the equivalents thereof.

What is claimed is:

1. A machine configured to transition a blank having a fold line extending therein directly between first and second panels thereof, the machine comprising:

(a) a side support configured to abut an underside of the first panel;

(b) a vacuum gripper comprising a suction cup that is extendable into suctioning engagement with an underside of the second panel when the side support abuts the underside of the first panel, and that is retractable while maintaining suctioning engagement with the underside of the second panel, wherein the vacuum gripper is configured to pull the second panel downward by retraction of the suction cup while maintaining suctioning engagement with the underside of the second panel and while the side support abuts the first panel, such that the first panel bends along the fold line upwardly relative to the second panel; and (c) a rod that is extendable from an opening in the side support into engagement with the underside of the first panel while the side support abuts the underside of the first panel following said retraction of the suction cup and bending of the first panel upwardly relative to the second panel and that is further extendable for further bending of the first panel along the fold line.

2. The machine of claim 1, wherein the rod is further extendable for further bending along the fold line of the first panel at least partially over a top side of the second panel.

3. The machine of claim 1, wherein the rod is configured to engage the underside of the first panel between (i) the abutment of the side support with the underside of the first panel and (ii) the fold line in the blank extending directly between the first and second panels.

4. The machine of claim 3, wherein an opening extends through the side support and the rod extends through the opening between opposite sides of the side support when the rod is extended into engagement with the underside of the first panel.

5. The machine of claim 1, wherein an opening extends through the side support and the rod extends through the opening between opposite sides of the side support when the rod is extended into engagement with the underside of the first panel.

6. The machine of claim 1, wherein the side support comprises a plate having a top edge on which the blank slides and is supported.

7. The machine of claim 1, wherein the vacuum gripper further comprises a piston having a distal end; a connector attached to the distal end; and a suction line attached to the connector; wherein the suction cup is attached to the connector and wherein the connector connects the suction line to the suction cup for the application of suction at the suction cup.

8. The machine of claim 1, wherein the vacuum gripper ceases the suctioning engagement with the underside of the second panel after the further bending of the first panel by the further extension of the rod while in the engagement with the underside of the first panel.

9. The machine of claim 1, further comprising a plunger in a plunging area of the machine, wherein the side support, vacuum gripper, and rod are located within the plunging area such that the plunger is configured to lower and engage the blank after the engagement of the rod with the first panel.

10. The machine of claim 9, wherein the vacuum gripper ceases the suctioning engagement with the underside of the second panel during the lowering of the plunger.

11. The machine of claim 1, further comprising three additional side supports, vacuum grippers, and rods for transitioning of the blank.

12. The machine of claim 1, wherein the first panel defines a corner of the blank prior to transitioning thereof by the machine.

13. A method of transitioning a blank having a fold line extending therein directly between first and second panels thereof, the method comprising the steps of:

(a) positioning the blank such that an underside of the first panel is supported by a side support; and (b) while the underside of the first panel is supported by the side support, (i) extending into suctioning engagement with an underside of the second panel a suction cup of a vacuum gripper, (ii) retracting the suction cup while maintaining suctioning engagement thereof with the underside of the second panel such that the vacuum gripper pulls the second panel downward and the first panel bends along the fold line upwardly relative to the second panel, and (iii) extending a rod from an opening in the side support into engagement with the underside of the first panel to effect further bending of the first panel along the fold line.

14. The method of claim 13, wherein the rod is extended such that the first panel is at least partially bent along the fold line over a top side of the second panel.

15. The method of claim 13, wherein the rod is extended to engage the underside of the first panel between (i) the area of support by the side support of the underside of the first panel and (ii) the fold line in the blank extending directly between the first and second panels.

16. The method of claim 15, wherein the rod extends through an opening in the side support between opposite sides of the side support when the rod is extended into engagement with the underside of the first panel.

17. The method of claim 13, wherein the rod extends through an opening in the side support between opposite sides of the side support when the rod is extended into engagement with the underside of the first panel.

18. The method of claim 13, wherein the side support comprises a plate having a top edge on which the blank slides and is supported when the blank is positioned.

19. The method of claim 13, further comprising ceasing the suctioning engagement of the suction cup with the underside of the second panel after effecting the bending of the first panel by the extension of the rod.

20. The method of claim 13, further comprising plunging of the blank with a plunger after or while ceasing the suctioning engagement of the suction cup with the underside of the second panel.

* * * * *